US011598601B2

(12) United States Patent
Prater

(10) Patent No.: US 11,598,601 B2
(45) Date of Patent: Mar. 7, 2023

(54) ARCHERY BOW CAM AND RELATED METHOD OF USE

(71) Applicant: Grace Engineering Corp., Memphis, MI (US)

(72) Inventor: Scott C. Prater, Imlay City, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

(21) Appl. No.: 17/343,346

(22) Filed: Jun. 9, 2021

(65) Prior Publication Data

US 2022/0397368 A1 Dec. 15, 2022

(51) Int. Cl.
*F41B 5/10* (2006.01)

(52) U.S. Cl.
CPC ..... *F41B 5/105* (2013.01)

(58) Field of Classification Search
CPC .... F41B 5/10; F41B 5/12; F41B 5/123; F41B 5/105; Y10S 124/90
USPC ..... 124/25, 25.6, 900, 86
See application file for complete search history.

(56) References Cited

U.S. PATENT DOCUMENTS 3,967,609 A 7/1976 Frydenlund
3,990,425 A 11/1976 Ketchum
4,054,118 A 10/1977 McKee et al.
4,338,910 A * 7/1982 Darlington ..... F41B 5/10 124/900
4,340,025 A * 7/1982 Caldwell ..... F41B 5/105 124/900
4,368,718 A 1/1983 Simonds et al.
4,455,990 A 6/1984 Barna
4,561,413 A 12/1985 Jennings
4,686,955 A * 8/1987 Larson ..... F41B 5/10 124/900
4,756,296 A * 7/1988 Darlington ..... F41B 5/105 124/900
4,770,154 A 9/1988 Cook et al.
4,838,236 A 6/1989 Kudlacek
4,957,094 A 9/1990 Pickering et al.
5,020,507 A * 6/1991 Larson ..... F41B 5/105 124/900
5,024,206 A * 6/1991 Lester ..... F41B 5/105 124/900
5,697,355 A 12/1997 Schaffer
6,237,582 B1 5/2001 McPherson
6,360,735 B1 3/2002 Larson et al.
6,446,619 B1 9/2002 McPherson
6,474,324 B1 * 11/2002 Despart ..... F41B 5/105 124/25.6
6,516,790 B1 2/2003 Darlington
6,666,202 B1 12/2003 Darlington
(Continued)

OTHER PUBLICATIONS

Hoyt Carbon RX-4, 2019.

*Primary Examiner* — Alexander R Niconovich
(74) *Attorney, Agent, or Firm* — Warner Norcross + Judd LLP

(57) ABSTRACT

An archery bow is provided including a cam rotatable about an axis, a bowstring disposed in a bowstring track of the cam having a plane of rotation perpendicular to the axis, and a power cable that is displaced along the axis toward the plane of rotation to concentrate a force of the power cable near a force of the bowstring along the axis to inhibit twisting of a limb, when the bow is drawn. A related method of use is provided.

20 Claims, 15 Drawing Sheets

(56) References Cited

U.S. PATENT DOCUMENTS

| | | | | |
|---|---|---|---|---|
| 6,688,295 | B1 | 2/2004 | Miller | |
| 6,792,930 | B1 | 9/2004 | Kronengold et al. | |
| 6,966,312 | B1 | 11/2005 | Larson | |
| 6,990,970 | B1 | 1/2006 | Darlington | |
| 7,971,582 | B1 * | 7/2011 | Larson | F41B 5/10 124/900 |
| 7,997,259 | B2 * | 8/2011 | Wilson | F41B 5/10 124/25.6 |
| 8,833,349 | B2 * | 9/2014 | Park | F41B 5/0094 124/25.6 |
| 9,354,015 | B2 | 5/2016 | Yehle | |
| 9,453,698 | B1 * | 9/2016 | Grace | F41B 5/1411 |
| 9,494,379 | B2 | 11/2016 | Yehle | |
| 9,879,936 | B2 * | 1/2018 | Yehle | F41B 5/105 |
| 9,885,535 | B2 * | 2/2018 | Evans | F41B 5/1403 |
| 10,209,026 | B2 | 2/2019 | Yehle | |
| 10,254,073 | B2 * | 4/2019 | Yehle | F41B 5/143 |
| 10,267,590 | B1 * | 4/2019 | Rinker | F41B 5/10 |
| 10,386,151 | B2 * | 8/2019 | McPherson | F41B 5/123 |
| 10,712,118 | B2 * | 7/2020 | Yehle | F41B 5/123 |
| 10,989,492 | B1 * | 4/2021 | Kempf | F41B 5/105 |
| 2002/0096159 | A1 | 7/2002 | McPherson | |
| 2003/0168051 | A1 | 9/2003 | Andrews | |
| 2005/0268892 | A1 | 12/2005 | Gallops, Jr. | |
| 2008/0029075 | A1 | 7/2008 | McMurray | |
| 2009/0188482 | A1 | 7/2009 | Strother | |
| 2009/0255520 | A1 | 10/2009 | Strother | |
| 2009/0288650 | A1 | 11/2009 | Batdorf | |
| 2010/0051005 | A1 | 3/2010 | Wilson | |
| 2010/0101549 | A1 | 4/2010 | Grace et al. | |
| 2010/0252013 | A1 | 10/2010 | Miller | |
| 2011/0023857 | A1 | 2/2011 | Grace | |
| 2018/0094895 | A1 | 4/2018 | Yehle | |
| 2019/0137212 | A1 | 5/2019 | Yehle | |
| 2019/0154392 | A1 | 5/2019 | Yehle | |
| 2019/0186863 | A1 | 6/2019 | Yehle | |
| 2020/0408482 | A1 | 12/2020 | Yehle | |

* cited by examiner

ARCHERY BOW CAM AND RELATED METHOD OF USE

BACKGROUND OF THE INVENTION

The present invention relates to archery bows, and more particularly to archery bows having cams that alter a power cable path to redistribute forces on a cam or limb during a draw cycle or a shot cycle.

Conventional compound archery bows include a bowstring and a set of power cables that transfer energy from the limbs and cams or pulleys, both generally referred to as "cams" herein, of the bow to the bowstring, and thus to an arrow shot from the bow. The power cables and bowstring may be strung from one cam on one limb to another cam on another limb of the bow. The function of the cams is to provide a mechanical advantage so that energy imparted to the arrow is a multiple of that required of an archer to draw the bow.

The cams on most compound bows include a bowstring track within which the bowstring is let out and/or taken up, and at least one additional power cable track within which power cables also are let out or taken up. The bowstring moves in a single plane, and is generally guided in that single plane by the bowstring track. The power cables are offset laterally from the single plane in which the bowstring moves, and generally are guided in cable tracks that are offset to the left or right of the bowstring track from the perspective of an archer holding or drawing the bow.

When the bowstring is drawn during a draw cycle, loads are dynamically shifted from the bowstring to the power cables. Due to the typical lateral offset of the power cable track and power cable from the bowstring and bowstring track, the cable loads are unbalanced relative to the longitudinal axis or central plane of the limbs. These unbalanced loads typically cause the cam to become overloaded on one side of a balance point, or generally unbalanced about the balance point, which results in the associated limb to twist or torque about its longitudinal axis, and further resulting in unwanted cam lean. This problem is exacerbated when a cable guard is employed on the bow because the cable guard further offsets the cables from the limb central plane.

The cam lean and limb twist generated by conventional compound bow cam assemblies can generate significant stress on the axle components and the bow limbs. Such frequent and significant longitudinal twisting also can accelerate fatigue and breakage of limbs. Cam lean and limb twist common to conventional cams also present other issues for an archer shooting the bow. For example, cam lean can cause non-parallel nock travel in the windage or horizontal plane. This can cause inconsistent left and right point of impacts of arrows shot from the bow. Cam lean further can require an archer to position sight pins, of a sight mounted to the bow, off center from the arrow to be shot from the bow. This can exacerbate windage error and point of impact for longer range shots, and can complicate sight set-up.

While conventional compound bow cams can provide reasonably satisfactory performance, there remains room for improvement to reduce cam lean, bow limb twist and/or excessive cable wear due to the same.

SUMMARY OF THE INVENTION

An archery bow is provided including a cam rotatable about an axis, a bowstring disposed in a bowstring track having a plane of rotation perpendicular to the axis, and a power cable that is displaced along the axis toward the plane of rotation, when the bow is drawn, to concentrate a force of the power cable near a force of the bowstring along the axis to inhibit twisting of a limb of the bow.

In one embodiment, the power cable can almost cross, can partially or fully intersect the plane, and/or partially or fully cross from one side of the plane to an opposing second side of the first plane as the archery bow is drawn, and vice versa when the archery bow is shot.

In another embodiment, a power cable can be displaced along the axis toward the plane of rotation of the bowstring track so that the power cable intersects the plane of rotation within a cam perimeter of the cam when the bow is drawn. Optionally, the power cable can be timed to the position of the bowstring track so that the power cable extends at least partially through a recess in the cam perimeter, for example at a location of a bowstring anchor.

In even another embodiment, the power cable can include an initial power cable contact point contacting a power cable take up track at a first distance from the first plane of rotation when the archery bow is undrawn. The power cable can include a subsequent power cable contact point contacting the power cable take up track at a second distance from the first plane of rotation when the archery bow is drawn. The second distance can be less than the first distance so that the subsequent power cable contact point is closer to the plane of rotation when the bow is drawn.

In still a further embodiment, the cam can include a power cable take up track and a power cable let out track. As the archery bow is drawn, both of these tracks can take up and let out different power cables, while displacing those power cables along the axis toward the plane of rotation, rather than away from the first plane of rotation.

In even a further embodiment, the power cable take up track can be parallel to the plane in a first section, but can angle and/or curve toward the plane in a second section. This structure and configuration can facilitate moving the power cable toward the plane as the cam rotates.

In yet a further embodiment, the power cable track can include a flared guide wall that extends upward asymmetrically from a U-shaped channel. The flared guide wall can transition toward the first plane in an angular and/or curved manner. The flared guide wall can be angled outward from a lateral side surface of the cam such that the outer edge of the flared guide wall is farther from the first plane than the first lateral side surface. The flared guide wall can capture and guide the power cable as the power cable enters the cable track to displace the cable toward the plane of rotation.

In even a further embodiment, a method of using an archery bow is provided. The method can include rotating a cam so that a bowstring received in a bowstring track unwinds from the bowstring track and so that a power cable is taken up in a power cable take up track and displaced along a first axis toward a plane of rotation of the bowstring track to concentrate a first force of the power cable near a first force of the bowstring along the first axis to inhibit twisting of a bow limb.

The current embodiments provide an archery bow and related method can provide well-balanced construction that inhibits or reduces cam lean, bow limb twist and/or excessive cable wear due to the same. The construction also can ensure straight nock travel for arrows propelled by the bowstring in a windage or horizontal plane. This can result in more consistent arrow flight in the windage or horizontal plane, which can reduce the likelihood of an arrow shot from the bow impacting left and/or right of a desired impact point. In addition, the construction can be forgiving on proper bow shooting form, as well as grip, as it is usually more difficult to improperly torque a bow including the construction. The cams described herein can be utilized on virtually any bow, including but not limited to a single cam system, a cam-and-a-half system, two-track binary cam system, a three-track binary cam system, a traditional dual cam system of a current embodiment, an eccentric axle dual cam system and/or any other cam or pulley system that is provided on an archery bow. This versatility makes the construction widely applicable to virtually all types of bows, including compound bows, crossbows and hybrid bows.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
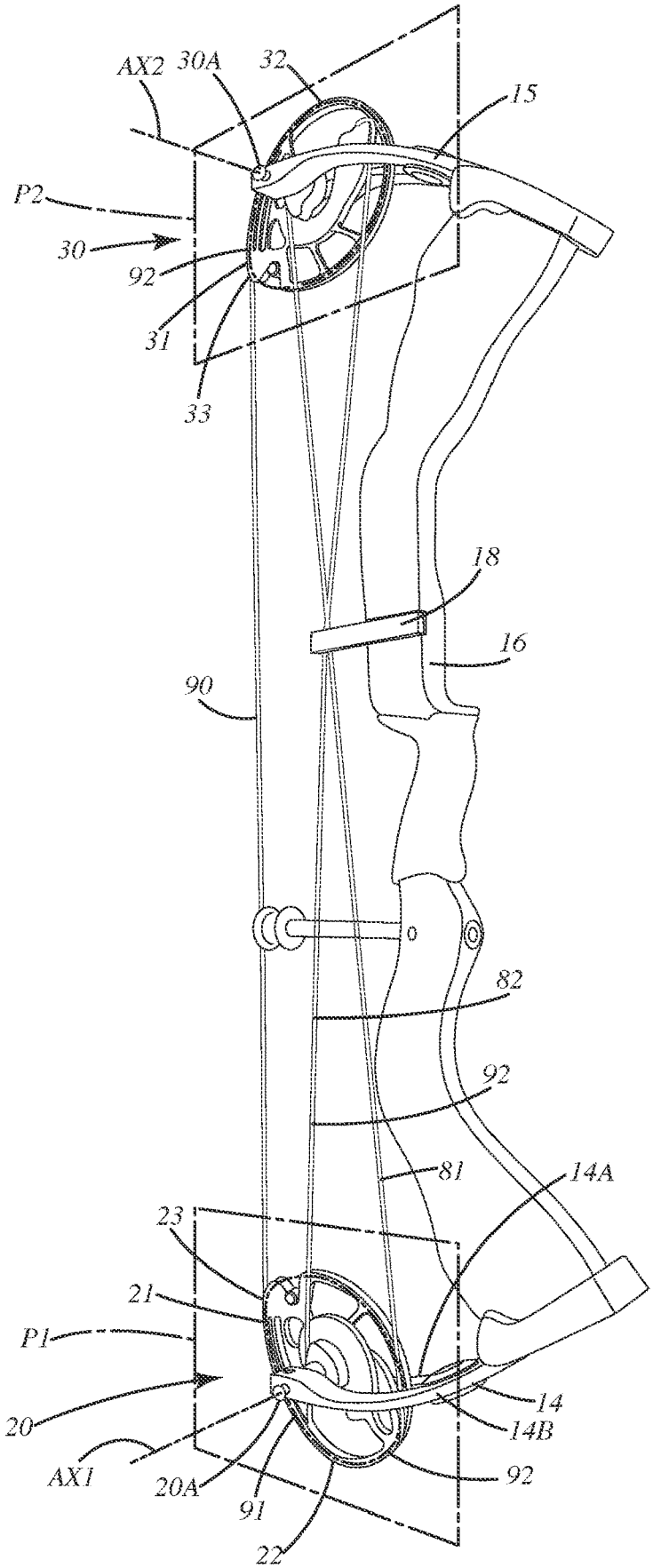
FIG. 1 is a perspective view of an archery bow having a cam system of current embodiment.

A compound archery bow including a cam system and a bowstring in accordance with a current embodiment is illustrated in FIGS. 1-5 and generally designated 10. The cam system 10 can include a first or lower cam 20 and a second or upper cam 30, which can form a dual cam system on the bow 10. The upper cam 30 can be mounted to an upper limb 15 and the lower cam 20 can be mounted to the lower limb 14 of the bow 10. The upper and lower limbs can be joined with the riser 16 of the bow, and spaced apart from one another in a desired configuration. In the current embodiment of a dual cam bow, the upper and lower cams can include generally the same components, and can operate in a similar manner. Accordingly, only the lower cam 20 will be described in significant detail herein, with the understanding that the upper cam 30 can include the same components and can operate in a similar manner in this embodiment and other embodiments herein.

Although the current embodiment of FIGS. 1-5 is described in connection with a dual cam bow, the cams 20, 30, bowstrings, cables and other features are suited for use with simpler pulley systems, for example, in single cam, cam and a half, and single cam systems as well. Further, the embodiments herein are well suited for cam assemblies of single cam compound archery bows, dual cam bows, cam and a half bows, crossbows and other archery systems including a cam and/or a pulley.

As used herein, a "cam" refers to a cam, a pulley, and/or an eccentric, whether a modular, removable part, or an integral part of a cam, for use with an archery bow. As used herein, "inhibit" refers to preventing, impairing and/or reducing a certain event, action, result, force, torque, twist and/or activity. As used herein, a "track" refers to a structural element that is adapted to guide or accommodate a portion of a bowstring or power cable within or adjacent the element, and can be in the form of a groove, a recess, a slot, pins or posts extending from or defined by a surface or element. When in the form of a groove or recess, that element can be defined by a part of a cam, and can be of virtually any geometric cross section, for example, partially or fully semi-circular, rounded, triangular, rectangular, square, polygonal, or combinations of the foregoing.

Figure 2:
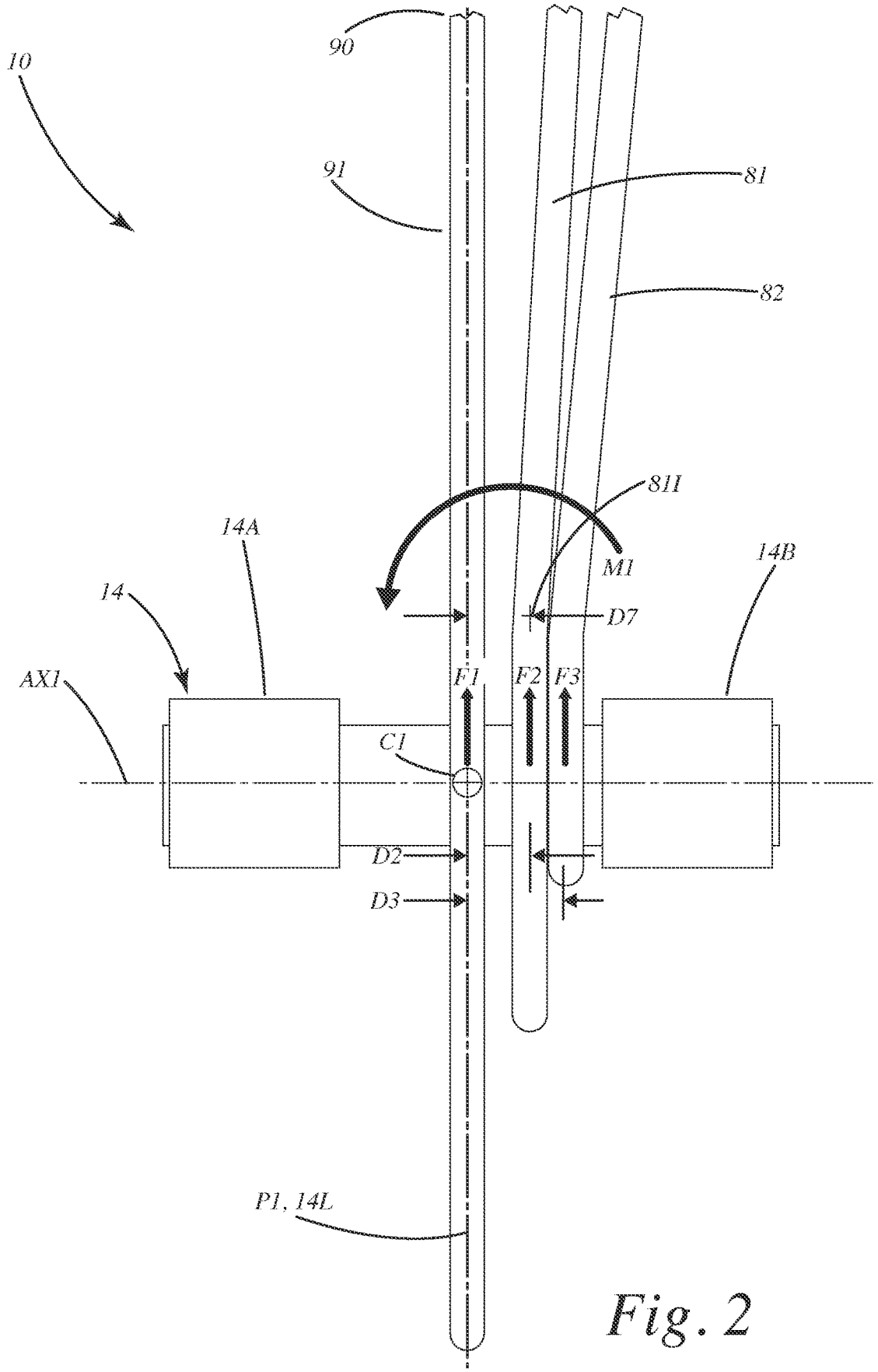
FIG. 2 is a schematic view of a bowstring and power cables on a lower cam of the archery bow in an undrawn state.

As used herein, an "axis of rotation", "first axis of rotation" or "second axis of rotation refers to an axis about which a cam can and/or does rotate, for example, a first axis AX1 or second axis AX2 as shown in FIGS. 1-2. These axes can coincide with the center of the axles 20A and 30A that mount the respective cams 20 and 30 to the first limb 14 and second limb 15. Optionally, the axle and/or limb can include suitable bearings to enhance rotation of the cams. Suitable bearings include, but are not limited to, bushings, roller bearings, and ball bearings. Further, a "center" of an axis of rotation, identified in FIGS. 2 and 3 as center CA, can substantially correspond to the center of the axle or axis of rotation located midway between the ends of the axle, or it can substantially correspond to the location at which the first plane of rotation P1 intersects a longitudinal center or central plane 14L of a limb 14 of the bow 10. A "plane of rotation" P1 and/or P2 can correspond to the planes of rotation perpendicular to the first axis AX1 and AX2 in which the bowstring tracks 21, 31 of the respective first cam 20 and second cam 30 rotate when the bow is drawn or shot.

Although not described in detail, the cams herein can include modular elements that provide some level of adjustment of a performance characteristic of a bow, including but not limited to, a particular draw length, draw stop or draw force for the bow. The cams can have secured thereto draw stops, anchors, bearings and other components. The cam components herein can be joined with one another via fasteners such as screws, rivets, welds, and other fastening structures. Alternatively, the cam components can be in the form of a monolithic, continuous single piece structure that includes the cam components and the respective features thereof.

The cams and the respective cam components, for example, the portions that define the bowstring tracks and power cable tracks as described below can be constructed from a rigid metal, polymeric, and/or composite structure, and can have a generally volute peripheral shape. Optionally, the cam assembly can be machined from metal, such as aluminum, magnesium or titanium, metal injection molded, and/or formed from a composite material with suitable properties.

As shown in FIGS. 1-4, the cams can include a corresponding first bowstring track 21 and second bowstring track 31. These bowstring tracks can extend along a sufficient portion of the outer perimeters 22 and 32 of each of the first and second cams 20 and 30, and can be of a preselected curvature to provide desired performance characteristics of the cams. For example, the bowstring tracks can follow a generally volute shape as shown, or if desired, they can follow a rounded or circular shape, or some other predefined shape depending on the operating and performance characteristics of the bow.

As mentioned above, the first 21 and second 31 bowstring tracks can lie and can rotate in the respective first P1 and second P2 planes, which are generally perpendicular to the axes AX1 and AX2 of rotation of the respective cams 20 and 30. Each bowstring track can include respective bowstring let out portions 23, 33, from which the respective first and second bowstring portions 91 and 92 of the bowstring 90 can be let out from when the bow 10 is drawn during a draw cycle. The bowstring let out portions can be contiguous with the remainder of the respective bowstring tracks as shown, or can be segmented or separate from the remainder of the bowstring tracks if desired.

Figure 3:
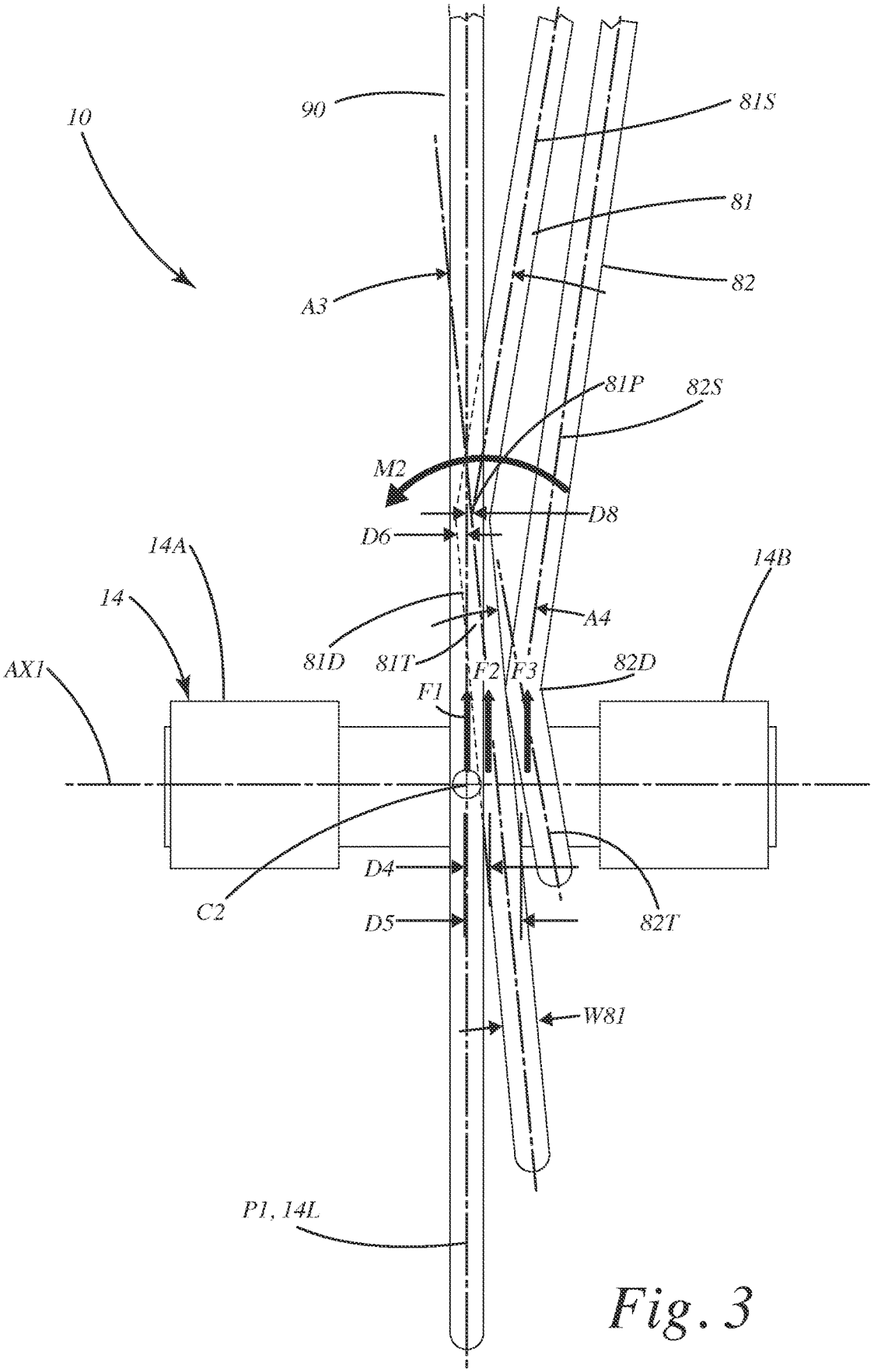
FIG. 3 is a schematic view of the bowstring and power cables on the lower cam of the archery bow in a drawn state with the power cables having been displaced toward a plane of rotation of a bowstring track in which the bowstring is held.
Figure 4:
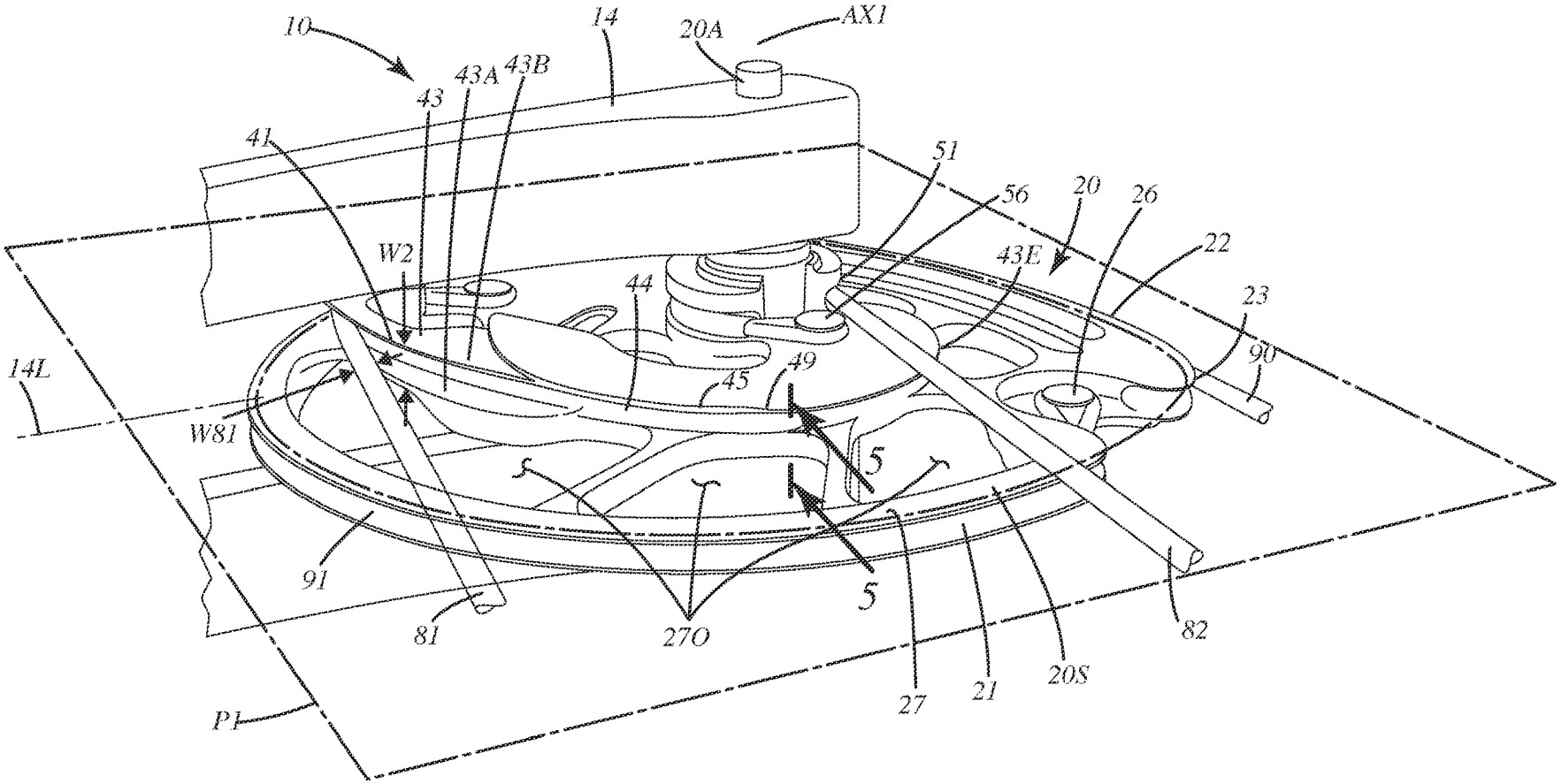
FIG. 4 is a perspective view of the lower cam with a first power cable in a first power cable take up track and a second power cable in a first power cable let out track.

Turning now to FIGS. 2-4, the operation of the cams and limbs, and the forces exerted thereon during a draw cycle, generally from an undrawn state to a drawn state, will now be described. As shown in FIGS. 2 and 4, the archery bow 10 is in an undrawn state, that is, the bowstring 90 has not been drawn to reel or unwind from the first cam 20 and from the first bowstring track 21 at the let out bowstring let out portion 23. It will be noted that only the first cam 20 is shown and described with reference to these figures, however, the structure function and operation of the second cam 30 is virtually identical but reversed in nature. FIG. 3 illustrates a schematic of the forces exerted by the bowstring 90 and the respective first power cable 81 and second power cable 82 on the axis AX1 and a corresponding axle 20A that is joined directly with the limb 14 between limb portions 14A and 14B. The cam 20 and its various bowstring or power cable tracks are not shown in FIGS. 2-3 for simplification.

With reference to FIGS. 2 and 4, where the bow is in an undrawn state, the bowstring 90, the first power cable 81 and second power cable 82 extend upwardly from the first cam 20 toward the second cam 30. The first power cable 81 can be journaled in a first power cable take up track 41 while the second power cable 82 can be journaled in a first power cable let out track 51. The bowstring is journaled in the first bowstring track 21. In the undrawn state, the bowstring 90 can exert a force F1 that is generally disposed, aligned and/or parallel with the first plane of rotation P1 as well as the centerline of the first limb 14. In the undrawn state, this exerts a force generally centered on the axis AX1, which is coincident with the center C1 of the axle 20A on which the first cam 20 is rotatably mounted to the limb. The first power cable let out track 41 can orient the first power cable 81 at a distance D2 from the first plane P1 and the centerline 14L. At this location, the first power cable 81 can exert a force F2 on the first axis AX1. The first power cable take up track 51 can orient the second power cable 82 at a distance D3 from the first plane P1 and the centerline 14L. At this location, the second power cable 82 can exert a force F3 generally on the first axis AX1.

The first force F1, second force F2 and third force F3 can simultaneously be exerted on the axis AX1. With the second force F2 and the third force F3 being exerted by the respective first power cable 81 and second power cable 82 offset at distances D2 or D3 respectively, the net result is a moment M1 is exerted on the limb 14 when the bow is in the undrawn state. Because the bow is in the undrawn state, this obviously does not have any effect on nock travel or the location of the bowstring.

With the current embodiments of the archery bow and cam described herein, when or as the archery bow is drawn to the drawn state shown in FIG. 3, the first power cable 81 is taken up in the first power cable take up track 41 and displaced along the first axis AX1 toward the first plane of rotation P1 as well as the centerline 14L of the limb 14. Simultaneously, but optionally at a different rate and to a lesser degree, the second power cable 82 is let out from the first power cable let out track 51 and displaced along the first axis AX1 toward the first plane of rotation P1 as well as the centerline 14L of the limb 14. In some applications, however, the second power cable let out track 51 might not displace the second power cable 82 along the first axis AX1 toward or away from the first plane of rotation P1 and/or the centerline 14L. Thus the force F3 exerted by the second power cable 82 can remain static along the axis AX1. As shown however, that force F3 transitions and is displaced toward the first plane P1.

Further optionally, the rates at which the respective first and second power cables approach and are displaced toward the first plane P1 can be the same, greater or lesser than one another. When the cam 20 has rotated through optionally at least 20°, at least 30°, at least 40°, at least 50°, at least 60°, at least 70°, at least 80°, at least 90°, at least 100°, at least 110°, at least 120°, at least 130°, at least 140°, at least 150°, at least 160°, at least 170°, at least 180°, at least 200°, at least 225° or at least 250°, the respective power cable take up track 41 and power cable let out track 51 has begun to displace the respective first and second power cables toward the first plane of rotation P1. Before that amount of rotation, the power cable may not have been being displaced substantially toward the plane.

Referring again to FIG. 3, the bow 10 can be in the fully drawn state. As shown there, the first force F1 exerted by the bowstring 90, which is fully drawn, remains located and centered along the first plane P1 as well as the centerline 14L. The forces F4 and F5 which are the new forces exerted by the first power cable 81 and second power cable 82, however have moved, transitioned, spatially reoriented or otherwise have been displaced toward the first plane P1 and the centerline 14L of the limb 14. This is because the first power cable 81 and second power cable 82 themselves have been moved, transitioned, spatially reoriented or otherwise have been displaced toward the first plane P1 and the centerline 14L of the limb 14. As a result, the forces of the first power cable and/or second power cable are concentrated near to, aligned with, parallel to, coincident with (any of which can be referred to as "near" herein), the force F1 of the bowstring along the first axis AX1.

Accordingly, with the concentration of these forces closer to the plane of rotation and/or the centerline 14L of the limb, twisting and/or torque exerted on the limb 14 can be reduced. For example, the moment M2 exerted about the point C2 located in the first plane P1 and along the centerline 14L as shown in FIG. 3 can be less than the moment M1 that is exerted about the point C1 located in the first plane P1 and along the centerline 14L as shown in FIG. 4. The limb 14 therefore can be inhibited from substantially twisting or rotating when the archery bow is in the drawn state shown in FIG. 3. Further, the cam 20 can be less inclined to lean out of the plane P1 due to the distribution of the forces near the center C2. In addition, it will be noted that the forces F4 and F5 of the first power cable 81 and second power cable 82 can remain generally at or near the locations shown in FIG. 3 after the bowstring is released, the cam 20 begins to rotate and the bow shoots or propels an arrow, returning to the undrawn state shown in FIG. 2.

Figure 14:
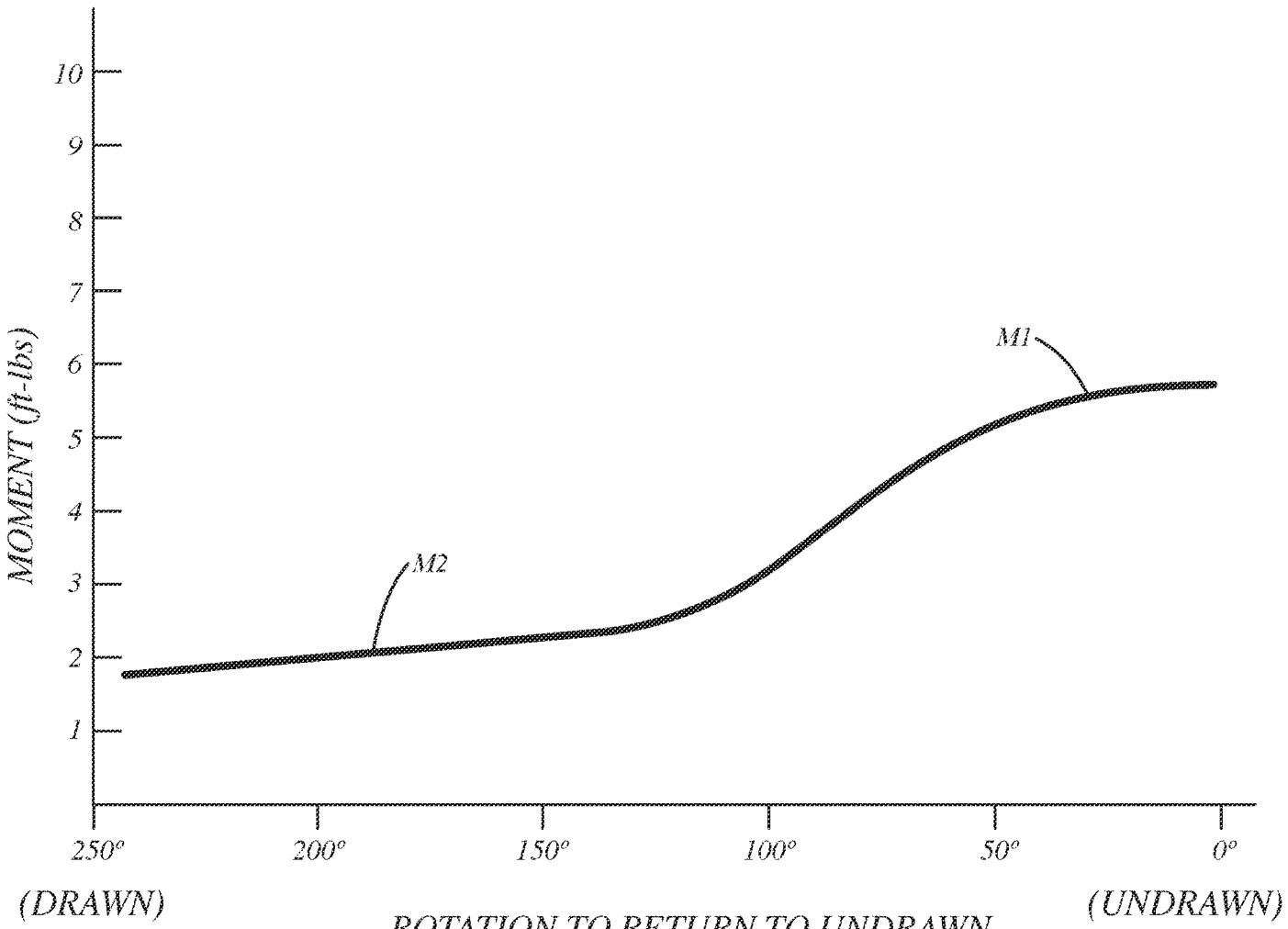
FIG. 14 is a graph illustrating the changing moments on a first limb as the first cam rotates from a drawn state to an undrawn state.

The moment M2 and the respective forces F4 and F5 can create the moment M2 which can change as the cam 20 rotates and the respective power cables 81 and 82 are wound out from and back onto the respective tracks as the cam rotates upon shooting of the bow. For example, as shown in FIG. 14, a moment is shown changing over time as the first cam 20 rotates while the archery bow transitions from the drawn state to the undrawn state. In the drawn state, the first cam 20 is rotated approximately 250° from its condition in the undrawn state. Therefore, in the drawn state, for example, as shown at 250° at the intersection of the axes, the moment M2 is at a relatively low moment of about 1 foot pound to about 4 foot pounds, or about 2 foot-pounds. As the bowstring is released, the cam 20 transitions and rotates from the drawn condition to the undrawn condition which is set at the value of 0°. For optionally at least 150°, at least 100°, at least 50° or at least 50° of that rotation in transitioning from the drawn to undrawn conditions, the moment exerted on the axis AX1 and thus the limb 14 can remain at a relatively low level of moment M2. It can then transition and increase as the respective first and second power cables are displaced away from the first plane P1 and the centerline 14L. Again, as this occurs, the forces of the power cables exerted along the axis AX1 transition to those shown in F2 and F3 shown in FIG. 2. The moment exerted on the limb 14 can increase to the greater moment M1. Of course, the reverse is true, that is when the bow is drawn from the undrawn state to the drawn state, the moment decreases from the moment M1 to the lesser moment M2, which also is illustrated in the graphic of FIG. 14.

The change in the moments from the greater moment, M1 to the lesser moment M2 as the first and second power cables 81 and 82 are displaced toward the first plane P1 and the centerline axis AX1 also can be understood referring to the distances of the forces of the power cables at locations along the first axis AX1. For example, as shown in FIG. 3, in the drawn state, the force F4 of the first power cable 81 is located a distance D4 from the first plane and centerline. This distance D4 is less than the distance D2 shown in FIG. 2, where the first power cable 81 and its respective force F2 in the undrawn condition are located at that distance D2. Further, as shown in FIG. 3, the force F5 of the second power cable 82 is located a distance D5 from the first plane P1 and the centerline 14L. This distance D5 is less than the distance D3 shown in FIG. 2, where the second power cable and its respective force F3 in the undrawn condition are located at the distance D3. By varying the distances of the respective forces from the plane P1 and center as the bow transitions from the undrawn state in FIG. 2 to the drawn state in FIG. 3, the effective moment can be reduced from a greater moment and M1 to a lesser moment M2 about the respective center C1, C2 depicted in those figures, which are in effect in the same location.

Again, the movement of the forces exerted by the first and second power cables is affected by and provided by the movement of the respective power cables 81 and 82 being displaced toward the first plane P1 which optionally can lay along the first centerline 14L of the limb 14. It will also be appreciated that with the lesser moment M2 being exerted on the cam 20 and 30 as the cams rotate certain amounts from the drawn state to the undrawn state during a shot, there is less cam lean and limb twist, which in turn results in more consistent and linear nock travel. This can result in more accurate, consistent and precise trajectories of arrows propelled from the bowstring and bow. It is also contemplated that the configuration of the respective power cable tracks can be constructed so that the moment M2 is maintained for a substantial portion of the release cycle such that that moment M2 does not substantially increase until after the nock of an arrow has disengaged the knock of the bowstring. Thus, any effect of the greater moment M1 on the cam 20, 30 and/or the respective bowstring or power cables would not significantly affect the arrow because it would have already disengaged the bowstring.

Optionally, when the first power cable 81 is being taken up by the first power cable take up track 41, it can move a greater amount toward the first plane P1 and centerline 14L than the second power cable 82 when being let out by the first power cable let out track 51. For example, the first power cable 81 and its associated force F2 in the undrawn state can transition to from the distance D2 to the distance D4 away from the first plane P1. The second power cable and its force F3 can transition from a distance D3 to a distance D5 closer to the first plane P1. The difference between D4 minus D2 can be greater than the difference between D5 minus D3. In some cases, the distance moved or displaced toward the first plane P1 by the first power cable 81 and its associated force on the first axis AX1 can be optionally at least 5%, at least 10%, at least 15%, at least 20%, at least 25% greater than the distance moved closer to the first plane P1 by the second power cable 82 and its associated forces on the first axis AX1. In other applications with other cam configurations, the distances moved by the first power cable and second power cable, and their attendant forces on the first axis AX1 can be equal or reversed.

With further reference to FIGS. 2-3, the degree and amount by which the first and second power cables move toward and/or intersect across the first plane P1 can be understood. As shown in FIG. 2, the first power cable 81 and second power cable 82 are distal from the first plane P1. As the bow is drawn to the drawn state shown in FIG. 3, however, the first power cable 81 can move nearer to the first plane P1 so that it is only a distance D6 from the first plane. That distance D6 can be less than the prior distance D7 in FIG. 2. Optionally, there can be an overlap of the width W81 of the cable 81 over the plane P1 by the distance D6. In some cases, the entire width W81 can cross over the plane P1. It will be appreciated that the associated first power cable take up track 41 as described below can also cross the first plane P1 by that distance D6 as well, or slightly more.

In the drawn condition shown in FIG. 3, the first power cable take up track 41 can be located between the bowstring track 21 and the first axis AX1 along a line drawn radially away from the axis in the drawn state shown in FIG. 3. This is why the first power cable 81 is shown broken lines, because it would be under or behind the bowstring 90 which is in the first bowstring track 21 from the view in FIG. 3. In some cases, the first power cable take up track and/or first power cable in that track in the drawn condition shown in FIG. 3 can be intersected by the plane P1 or can lay immediately adjacent to that plane P1.

In other cases, as shown, these components can intersect and/or pass through the plane by certain amount, generally crossing from one side of the first plane to an opposing second side of the first plane as the archery bow is drawn. As a result, the first power cable 81 is guided and deflected or displaced toward and/or through the first plane P1 by the first power cable take up track. It will be appreciated that as the first power cable is in the condition shown in the when the bow is drawn as shown in FIG. 3, it can pass from a first lateral side of the first plane P1 partially or fully through the first plane P1 so that it extends on an opposing second side of that plane, and then back to the first lateral side of the first plane P1 as it extends toward the second cam 30 and second limb 15 at the other end of the bow 10.

As shown in FIG. 3, the first power cable 81 can intersect the first plane of rotation P1 within the first cam perimeter 22 of the first cam 20 before the archery bow is fully drawn, and when the archery bow is fully drawn. Again, this intersection can occur at the location 81D, when the bow is fully drawn, and for a portion of the section 81T that extends within the first power cable take up track.

Returning to FIG. 2, the first power cable can include contact points that contact the first power cable take up track 41 at different distances when the bow is drawn and undrawn. For example, as shown, the first power cable 81 can include an initial power cable contact point 811 that contacts the first power cable take up track at a first distance D7 from the first plane P1 when the archery bow is undrawn. When the archery bow is drawn as shown in FIG. 3, a subsequent power cable contact point 81P contacts the first power cable take up track 41 at a second distance D8 from the first plane P1. This second distance D8 can be less than the first distance D7 so that the subsequent power cable contact point 81P is closer to the first plane P1 when the bow is drawn than the initial contact point 811 is to the first plane P1 when the bow is undrawn.

Optionally, as shown in FIG. 3, where the first power cable last touches the first power cable take up track 41 at the location 81D, the power cable section 81S can transition from that location 81D at an angle A3 relative to the track portion 81T of the first power cable that remains in the power cable take up track 41. This angle A3 can be an acute angle and can be sufficient for the section 81S to clear the perimeter 22 of the cam 20. This angle A3 can be produced by virtue of the cable 81 being held outward from the bowstring plane, within which the bowstring moves, via the cable guard 18 as shown in FIG. 1.

The cable guard 18 can effectively exert a force on the cable 81 to hold or direct it away from the first plane P1 at a predetermined angle A7 at the location 81P as the bow is drawn. This can be better understood with reference to FIG. 3A. There, the bowstring 90 is at full draw. The first power cable 81 is disposed in the first power cable track 41, and more particularly extending out from the first end of draw part or portion 43E, which can be the last part of the track that contacts the first power cable and the subsequent contact point 81P of the power cable when the bow is fully drawn. In this configuration, the track 41 has urged and guided the cable 81 near the part 81P toward and closest to the first plane P1. As can be seen in broken lines, the cable 81 and the part of the track holding the cable 81 nearest the plane P1 is actually disposed below the bowstring track 21 and bowstring 90 itself. This means that the part 81X of the cable and its associated track 41 and part 81P are located between the bowstring/bowstring track and the axis AX1 when taking a radial line emanating from the axis AX1 though the part 81X.

Figure 3A:
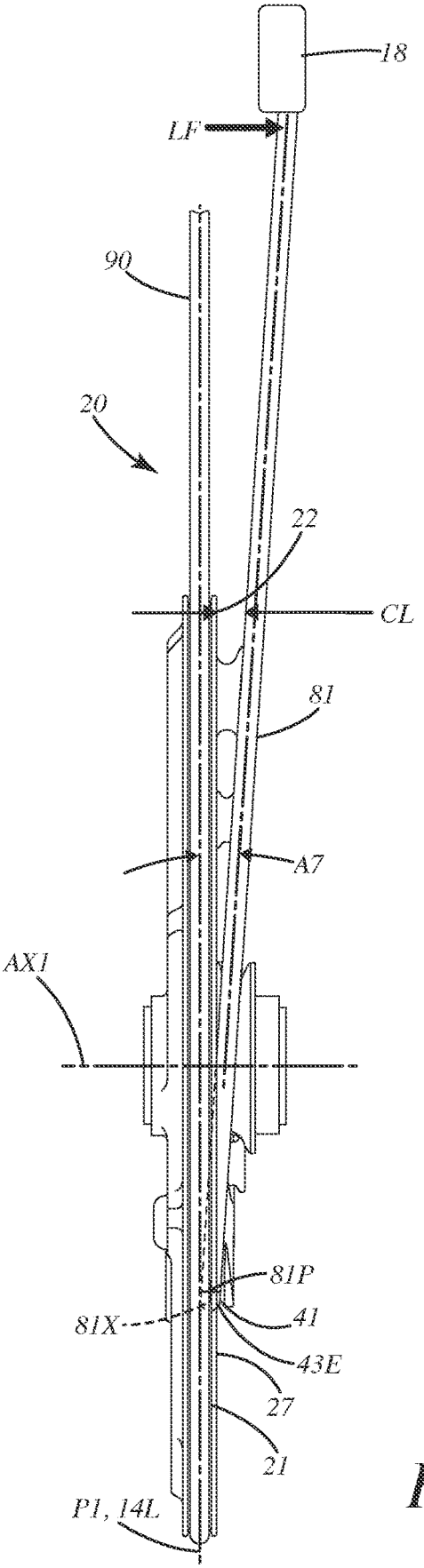
FIG. 3A is a rear view of the lower cam with a first power cable in a first power cable take up track with the bow and lower cam in a drawn configuration.
Figure 13:
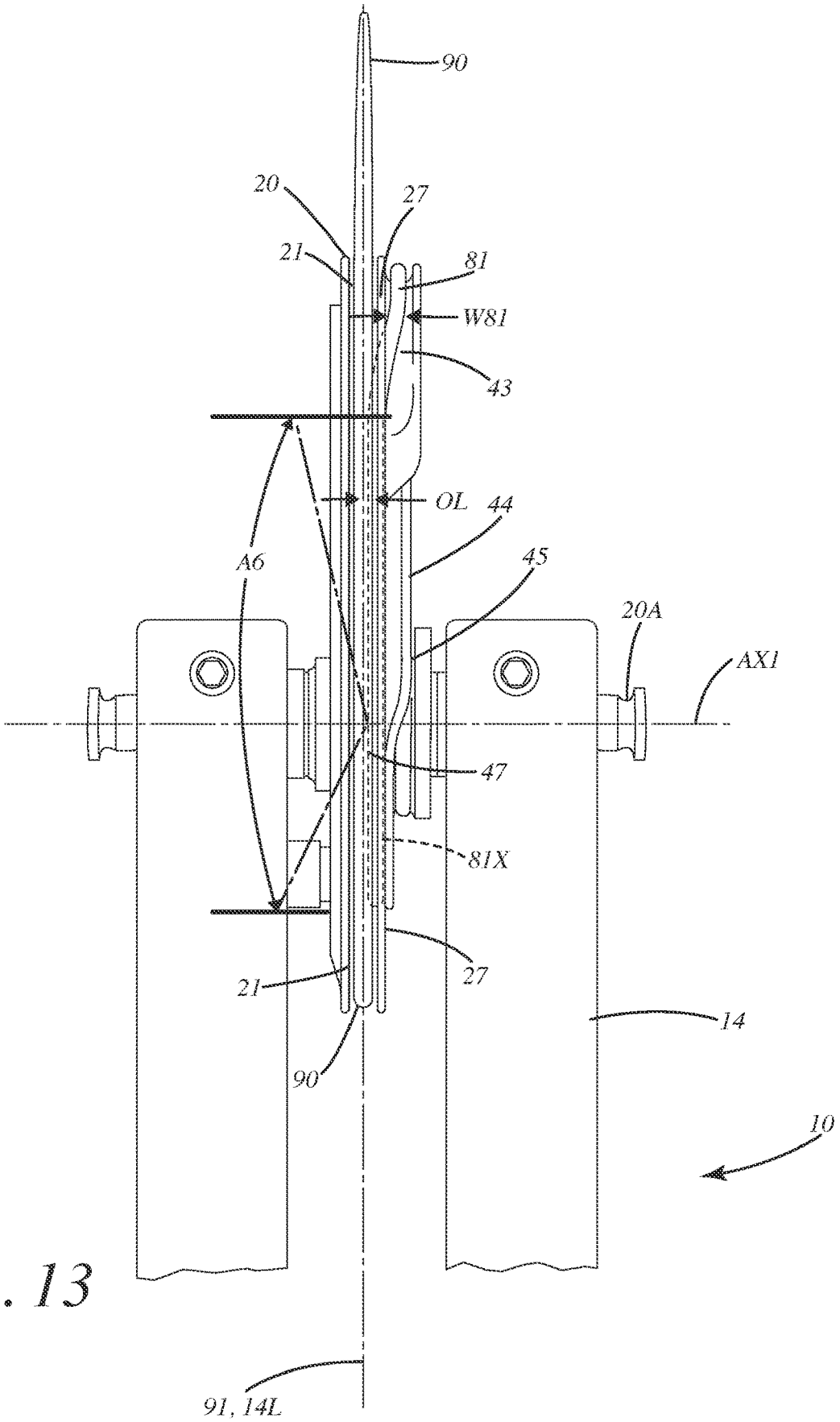
FIG. 13 is a lower perspective view of the lower cam on the archery bow as the bow is at full draw with the power cables displaced toward the axis of rotation of the bowstring track.

Due to the overlap of the bowstring and the bowstring track over the cable 81 and cable track 41, the cable 81 can be angled outward at angle A7 relative to the plane P1 so that the cable has enough clearance CL at the outer perimeter 22 of the cam to clear the cam at all times when the bow is drawn, shot or undrawn. With this clearance CL, the cable 81 will not touch the cam 20 along its parts that are outside the track 41, even when parts of the power cable 81 are under the bowstring and/or bowstring track, or generally between the axis and the bowstring and/or bowstring track as shown in FIG. 2, 3A or 13. The angle A7 can optionally be an acute angle, for example between 1° and 10°, inclusive, between 1° and 5°, inclusive, between 1° and 4°, inclusive, less than 10°, less than 5°, or less than 3° depending on the application.

The angle A7 can be produced via the cable guard 18, which can exert a force LF on the cable 81 (and cable 82, although not shown) to urge the part of the cable outward, distal from the cams, away from the planes P1 (and P2, although not shown). When the cable guard exerts this force LF and produces the angle A7 in the cable at the point 81P, the cable is enabled to fit under the bowstring track/bowstring, much closer to the plane P1, without concern of other parts of the cable rubbing on other parts to the cam, because the clearance CL is created. Optionally, in some alternative applications without the cable guard, or some other element exerting a force LF to produce the angle A7, the cable distal from the point 81P might interfere with or rub on other parts of the cam. Further optionally, although a cable guard of a compound archery bow is shown as producing the force to create the angle A7, it is contemplated that such a cable guard can alternatively be replaced or substituted with a barrel, a rail or other guide on a crossbow or other archery bow that uses cables.

Figure 5:
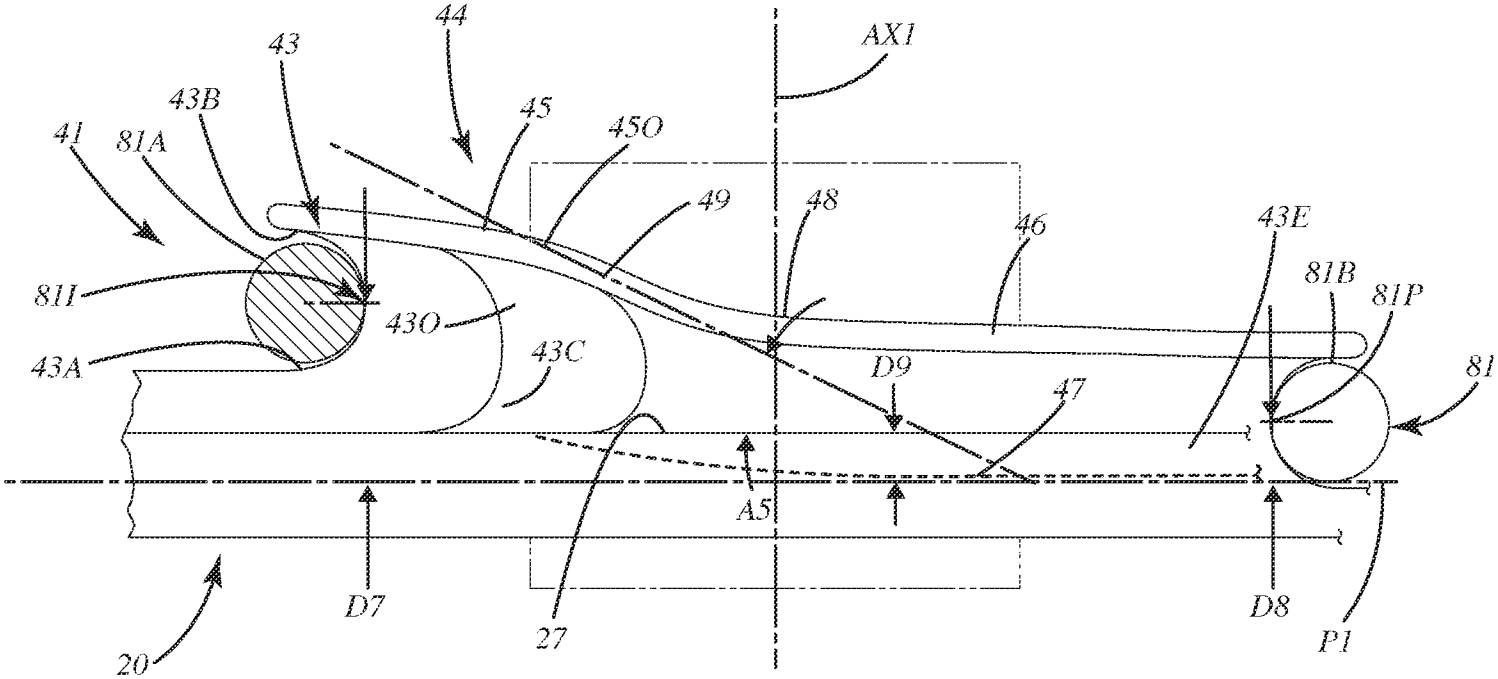
FIG. 5 is a perspective view of a flared guide wall on the first power cable take up track.

Movement of the power cables relative to the plane P1 can be further understood with reference to FIG. 5. There, the first power cable take up track is shown with sections 81A and 81B of the first power cable 81. The section 81A represents where the first power cable is located initially in the track 41, before the bow is drawn and the cam 20 rotates. The section 81B represents where the first power cable is located subsequently, in a final cable location in the track 41, after the bow is drawn and the cam 20 rotates. There, it can be seen that when in the initial position at section 81A, the initial point of contact 811 of the cable 81 is at the distance D7 from the first plane P1 before the bow is drawn and the cam 20 rotates. When in the subsequent position at section 81B, the subsequent point of contact 81P of the cable 81 is at the distance D8 from the first plane P1 after the bow is drawn and the cam 20 rotates. As evident, D8 is less than D7, which illustrates that the cable 81 was moved inward, toward the first plan P1 by the track 41 and its components as described below, as the bow is drawn from the undrawn state.

With reference to FIGS. 1-4, as noted above, the first power cable let out track 51 can let out the second power cable 82 when the bow is drawn. Where the first power cable let out track 51 is configured to displace the second power cable 82 toward the first plane P1, the power cable and the associated forces can move toward that first plane P1 as shown in FIG. 3 when the bow is in the drawn state or transitioning to it. Because the first power cable let out track 51 is farther away from the first plane P1, the second power cable 82 typically does not cross or intersect the first plane 41 or the centerline 14L of the limb 14. Instead, it can move closer to it. Optionally, the first power cable can be closer to the first plane P1 than the second power cable 82 even in the drawn state shown in FIG. 3.

Optionally, where the second power cable last touches the first power cable let out track 51 at the last contact portion 82D, the power cable section 82S that extends to the second cam 30 transitions from that last contact portion 82D at an angle A4 relative to the track portion 82T, which remains in the first power cable let out track. 51. This angle A4 can be an acute angle and optionally can be less than the angle A3 mentioned above.

Turning now to FIG. 4, the configuration of the respective power cable tracks of the cam 20 will be described in more detail, noting that the power cable tracks of the second cam 30 can be similar or identical in structure, operation and function. As mentioned above, the first power cable take up track 41 can be disposed inwardly from the outer perimeter 22 of the cam 20. The first power cable take up track 41 can be of a generally eccentric or volute shape extending around the first axis AX1. The first power cable take up track can curve around the first axis AX1 toward the first plane P1 so that the first power cable 81 is guided toward the first plane as the first power cable is taken up in the first power cable take up track, curving toward the first plane as the bow is drawn.

Generally, the first power cable take up track can extend in a direction perpendicular to the plane of rotation of the first bowstring track 21. As illustrated in FIG. 4, it can extend upwardly or laterally away from the side surface 20S of the first bowstring track 21. The first power cable take up track can include a first section 43 and a second section 44. The first section can be parallel to the first plane P1 and/or the first bowstring track 21. The second section 44 can angle toward the first plane P1 and/or the first bowstring track 21. The second section 44 can be nearer to a first bowstring anchor 26 than the first section 43. Although the second section 44 is shown to angle toward the first plane, in that region the track 41 can curve spiral or otherwise extend generally toward the first plane.

The first power cable take up track 41 optionally can include or be in the form of a U- or V-shaped channel or groove that extends around a portion of the first axis AX1, optionally in an eccentric and/or volute configuration. The first section 43 of the track can be generally U-shaped and of a slightly wider width W2 then the width W81 of the first power cable 81. This first section as mentioned above can transition to a second section 44 where the track 41 transitions toward and closer to the first plane P1 so that it can displace the power cable toward that first plane P1 as the bow is drawn. The first section 43 can include first and second side walls 43A and 43B that form the upwardly extending portions of the channel. These sidewalls can be symmetric relative to one another.

As shown in FIGS. 4-5, the first power cable track can include a first flared guide wall 45, optionally located in the second section 44. This first flared guide wall 45 can extend upward and asymmetrically from the U-shaped channel. For example, the sidewall 43C in the second section 44 can oppose the outwardly flared sidewall 45. The sidewall 43C can be similar in height and contour to the sidewall 43A in the first section 43. In contrast, the flared sidewall 45 can be rather different from sidewall 43C, and can form an integral extension of the opposing sidewall 43D. This first flared guide wall 45 can extend toward and/or transition toward the first plane P1 and can act to capture and guide the first power cable 81 toward that first plane P1.

With further reference to FIG. 5, the first flared guide wall can be angled outward at an angle A5 relative to a first lateral side wall 27 of the first cam 20. The first lateral side wall 27 optionally can define multiple openings 270 therein for weight reduction of the cam. The lateral side wall 27 can be planar. The angle A5 can be optionally between 0° and 60°, inclusive, between 20° and 60°, inclusive, or between 20° and 45°, inclusive, depending on the application. This flared guide wall 45 can include an outer edge 450 that is generally farther from the first plane P1 than the first lateral side surface 27 and also farther from the first plane P1 than a secondary sidewall 48 that extends to an end 43E of the track 41. Where the secondary sidewall 48 and the flared guide wall 45 meet, a sloped transition 49 can be located. This transition 49 can be a smooth and rounded transition so that the first power cable will glide along and not become hung up in the transition between the flared guide wall 45 and the secondary sidewall 48.

Optionally, as further shown in FIG. 5, the inner side wall 47 of the power cable track 41 that opposes the secondary sidewall 48 can transition closer to the first plane P1 than the first lateral side wall 27 of the cam. This inner side wall 47 can be inset or sunken relative to the first lateral side wall 27. In turn, this can allow the first power cable in this portion of the power cable track 41 to be displaced and positioned even closer to the first plane P1 than the first lateral side surface 27, for example, along the perimeter 22 of the cam 20. The depth D9 of this sidewall below the first lateral side surface 27 can vary depending on the application, but in some cases can be optionally at least ⅛, at least ¼, at least ½, at least ¾ or more of the width W81 of the first power cable 81.

The first power cable take up track 41 can include the first end of draw part or portion 43E. This first end of draw part 43E can be the last part of the track that contacts the first power cable and the subsequent contact point 81P of the power cable when the bow is fully drawn. Optionally, the first plane of rotation P1 can extend through the first bowstring track 43 and through the first end of draw part 43E, or otherwise intersect or cross the first end of draw part of the track. This first end of draw part 43 also can be located between the first axis AX1 and the first bowstring track 21 along a radial line emanating from the axis AX1.

Returning to FIG. 4, as mentioned above, the first cam 20 can include a first power cable let out track 51. The second power cable 82, which extends from the second cam 30 and the opposite limb of the archery bow, can be received in the first power cable let out track on the first cam 20. This first power cable let out track can be configured so that as the archery bow is drawn, the second power cable 82 is let out by the first power cable let out track 51 and displaced along the first axis AX1 toward the first plane P1 of rotation of the first cam 20 and/or bowstring track 21. Generally, the first power cable let out track can be of an angled and/or spiral shape that extends from an anchor 56 around the axis AX1 toward the first plane P1. Of course, in other applications, this track can lay within a single plane, parallel to, or without angling or curving toward, the first plane P1.

A method of using the archery bow and the respective cams 20, 30 thereof will now be described in further detail with reference to FIG. 6-13. In general, the method can include rotating a cam so that a bowstring received in a bowstring track unwinds from the bowstring track and so that a power cable is taken up in a power cable take up track and displaced along a first axis toward a plane of rotation of the bowstring track to concentrate a first force of the power cable near a first force of the bowstring along the first axis to reduce twisting and/or torque experienced by a bow limb. In some cases, a portion of the power cable crosses the first plane between the bowstring track and the first axis above the lowermost portion of the first cam when the archery bow is fully drawn. Where the power cable take up track includes a flared guide wall extending outward from a lateral side surface of the cam, that flared guide wall can guide the power cable toward the first plane.

Figure 6:
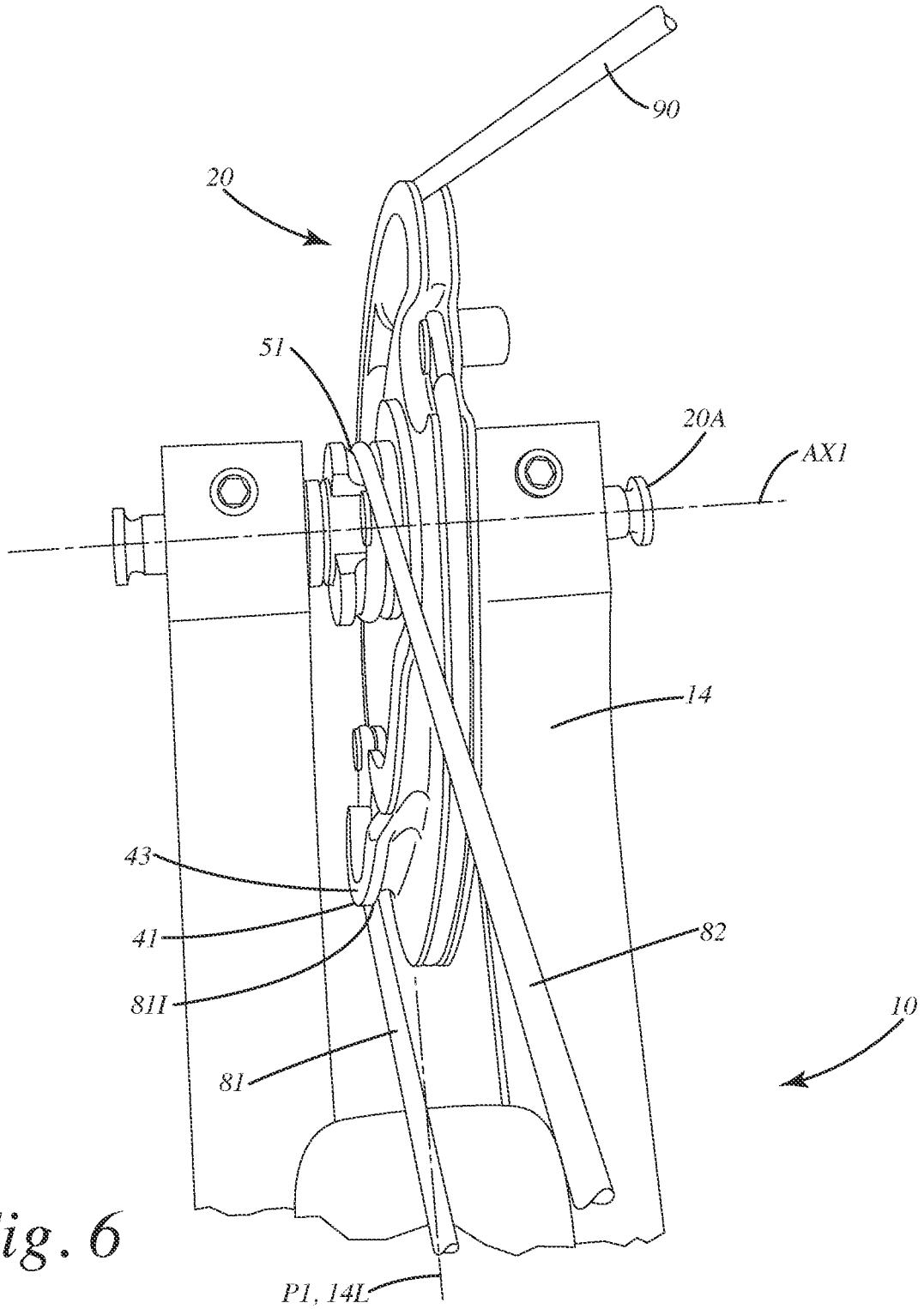
FIG. 6 is an upper perspective view of the lower cam on the archery bow in an undrawn state.
Figure 10:
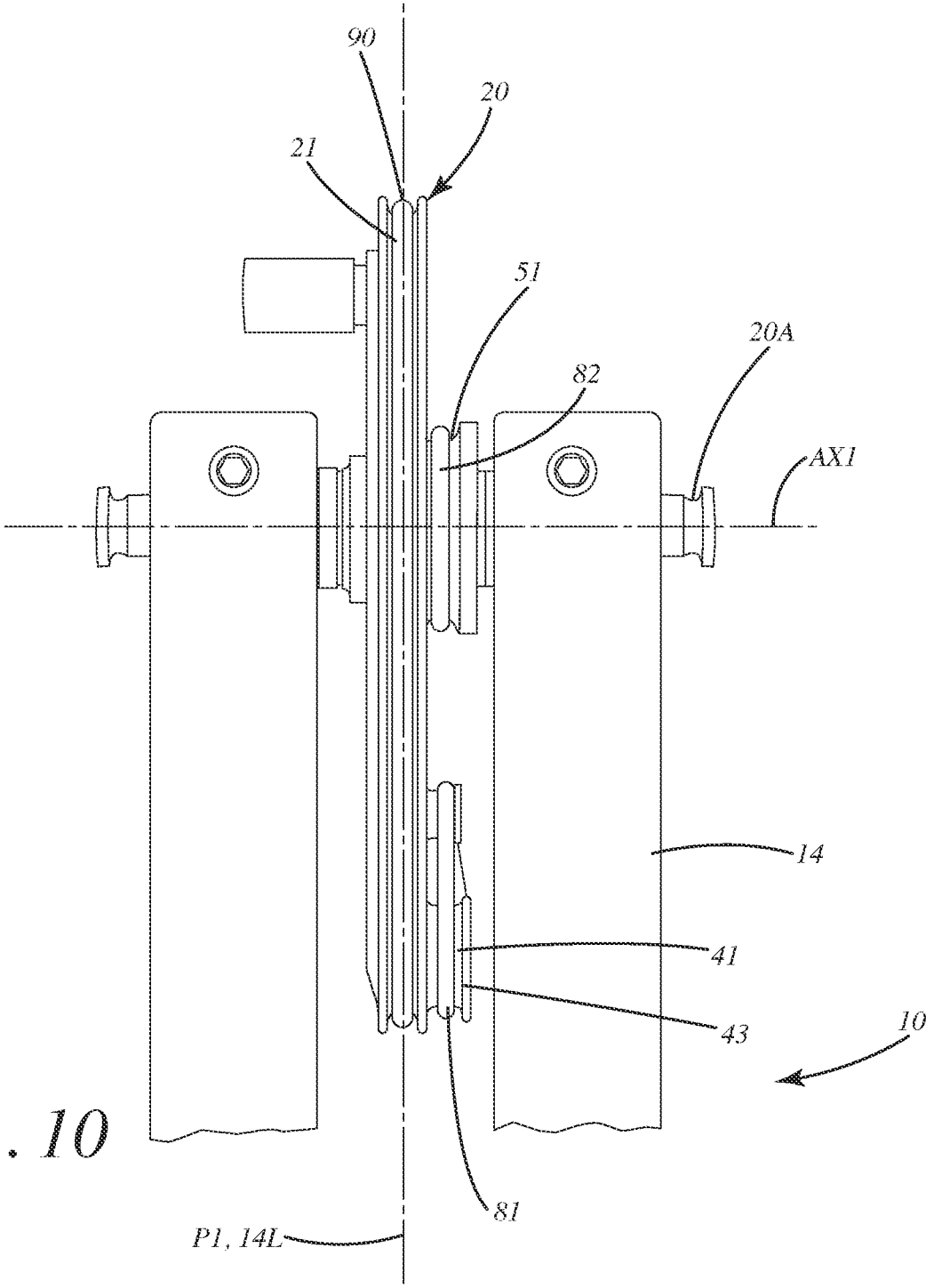
FIG. 10 is a lower perspective view of the lower cam on the archery bow as the bow is in an undrawn state.

With reference to FIGS. 6 and 10, the bow 10 is shown in an undrawn state. The cam 20 is mounted with an axle 20 to the limb 14. In this initial condition, the first power cable 81 extends from the power cable take up track 41 with the initial contact point 811 being disposed and extending from the first section 43, without contacting the second section 44 or the flared guide wall 45. The second power cable also extends from the power cable let out track 51. The first and second power cables 81, 82 can extend to the opposing second cam 30 and can be disposed a similar take up and let out tracks. As shown in FIG. 10, which shows a lower perspective view of the first cam 20, the first power cable 81 and the section shown there can be generally parallel to the first plane P1 and the center 14L of the limb 14.

Figure 7:
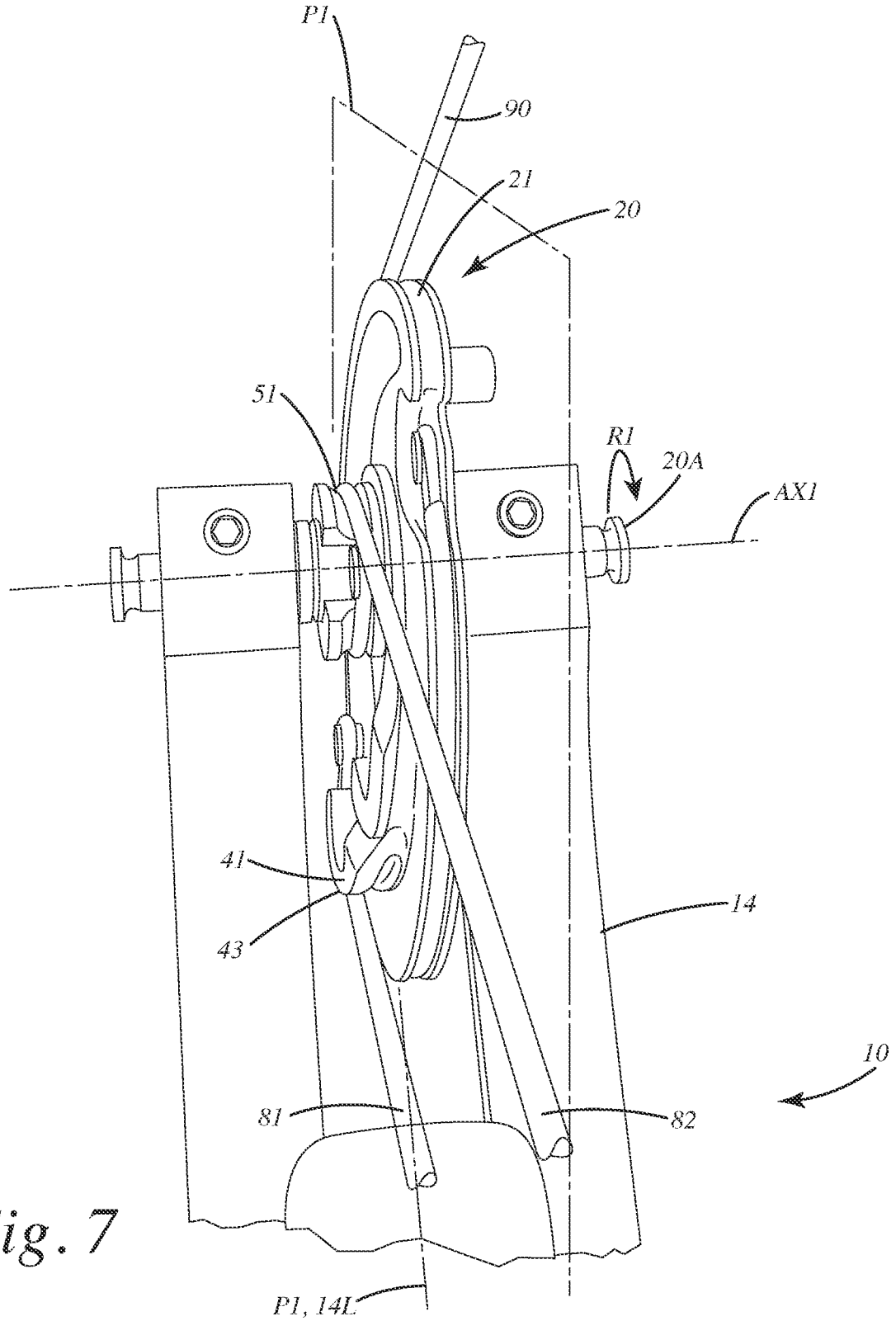
FIG. 7 is an upper perspective view of the lower cam on the archery bow as the bow is initially being drawn.
Figure 11:
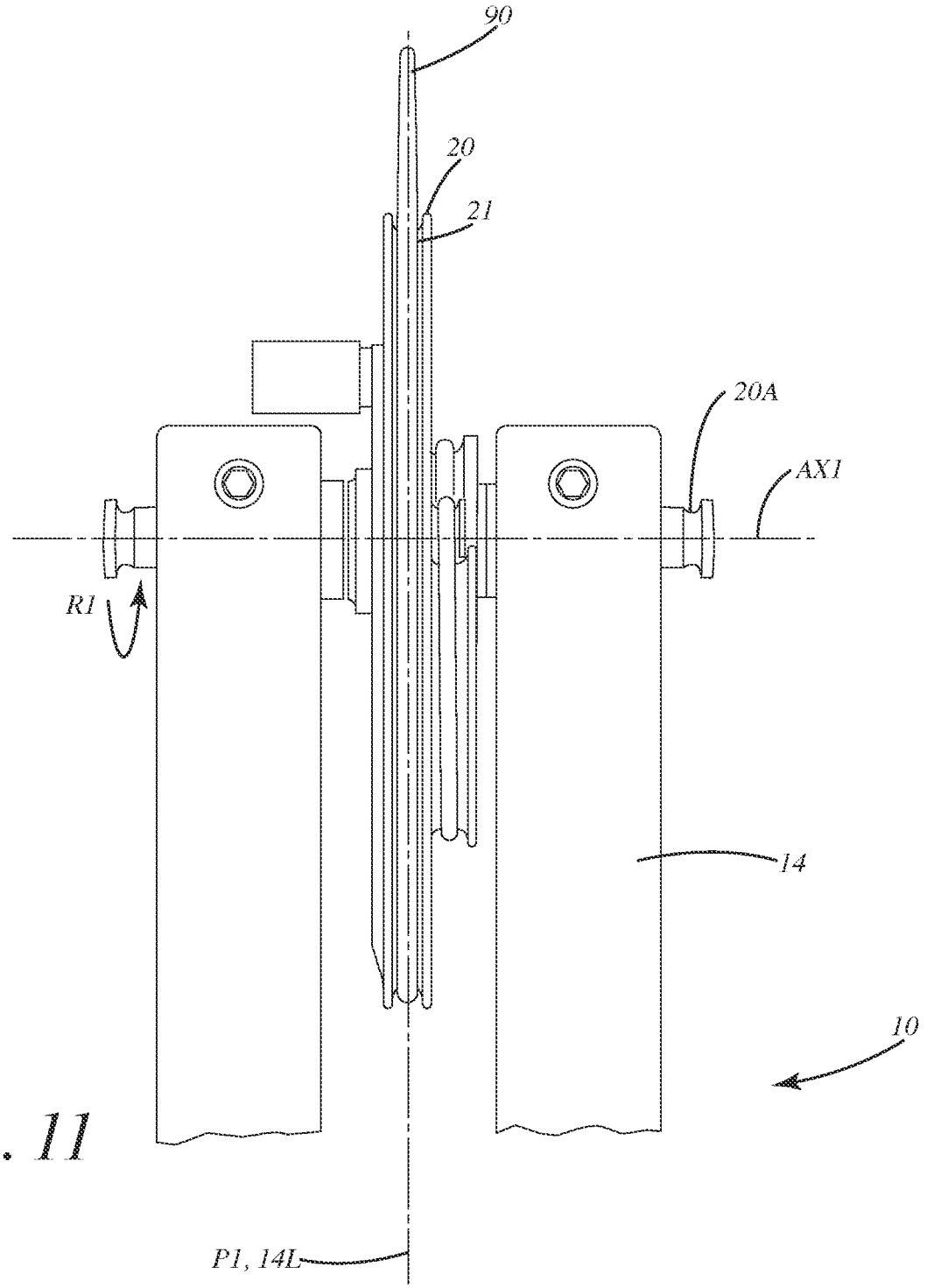
FIG. 11 is a lower perspective view of the lower cam on the archery bow as the bow is initially being drawn.

As the bow 10 is initially drawn as shown in FIGS. 7 and 11, the cam 20 rotates in direction R1. The bowstring 90 exits the bowstring track 21. The second power cable 82 also begins to exit power cable let out track 51. The first power cable 81 begins to further enter and wind into the first power cable take up track 41 starting to extend through the first section 43 thereof.

Figure 8:
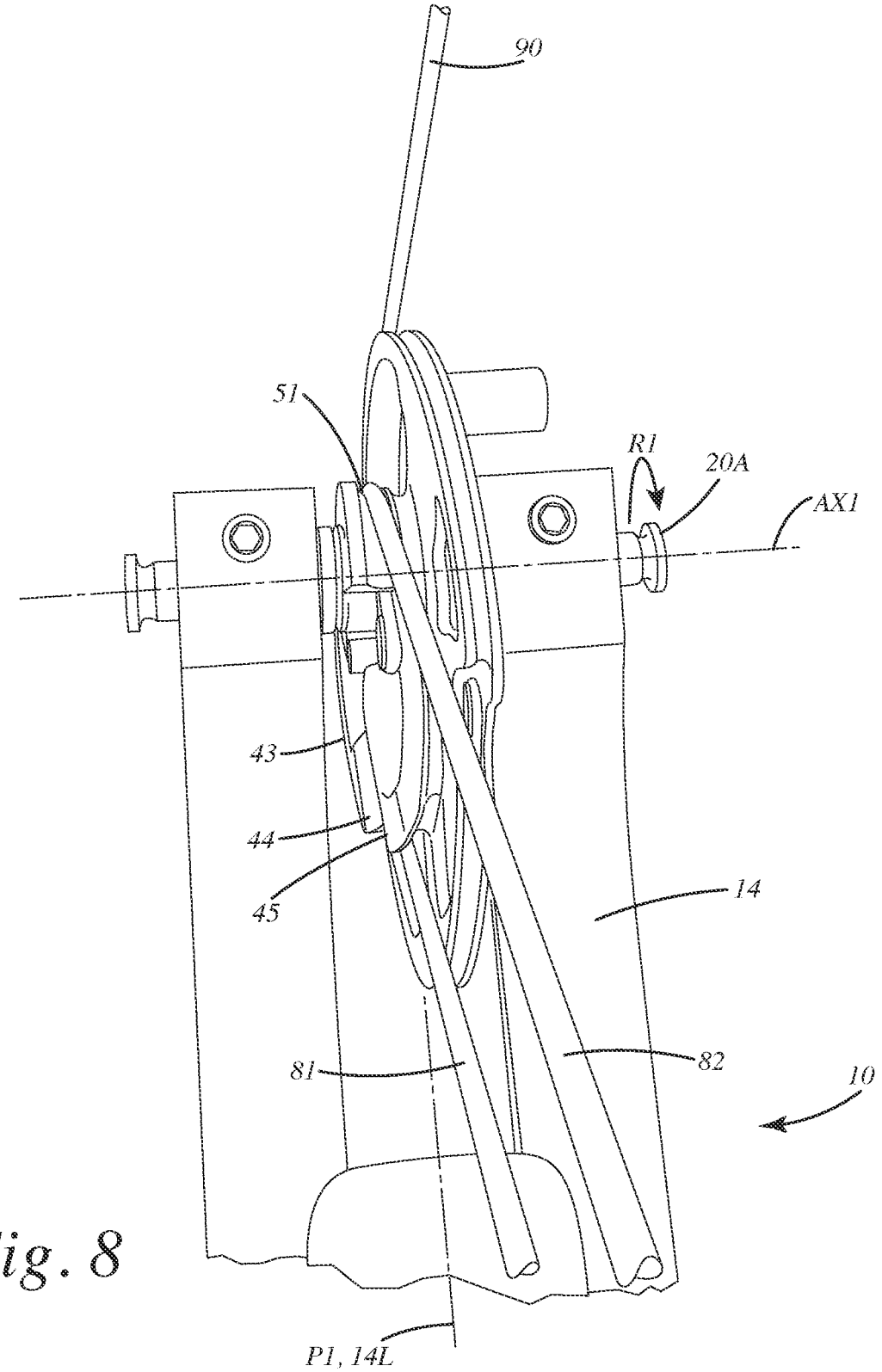
FIG. 8 is an upper perspective view of the lower cam on the archery bow as the bow is further being drawn.
Figure 12:
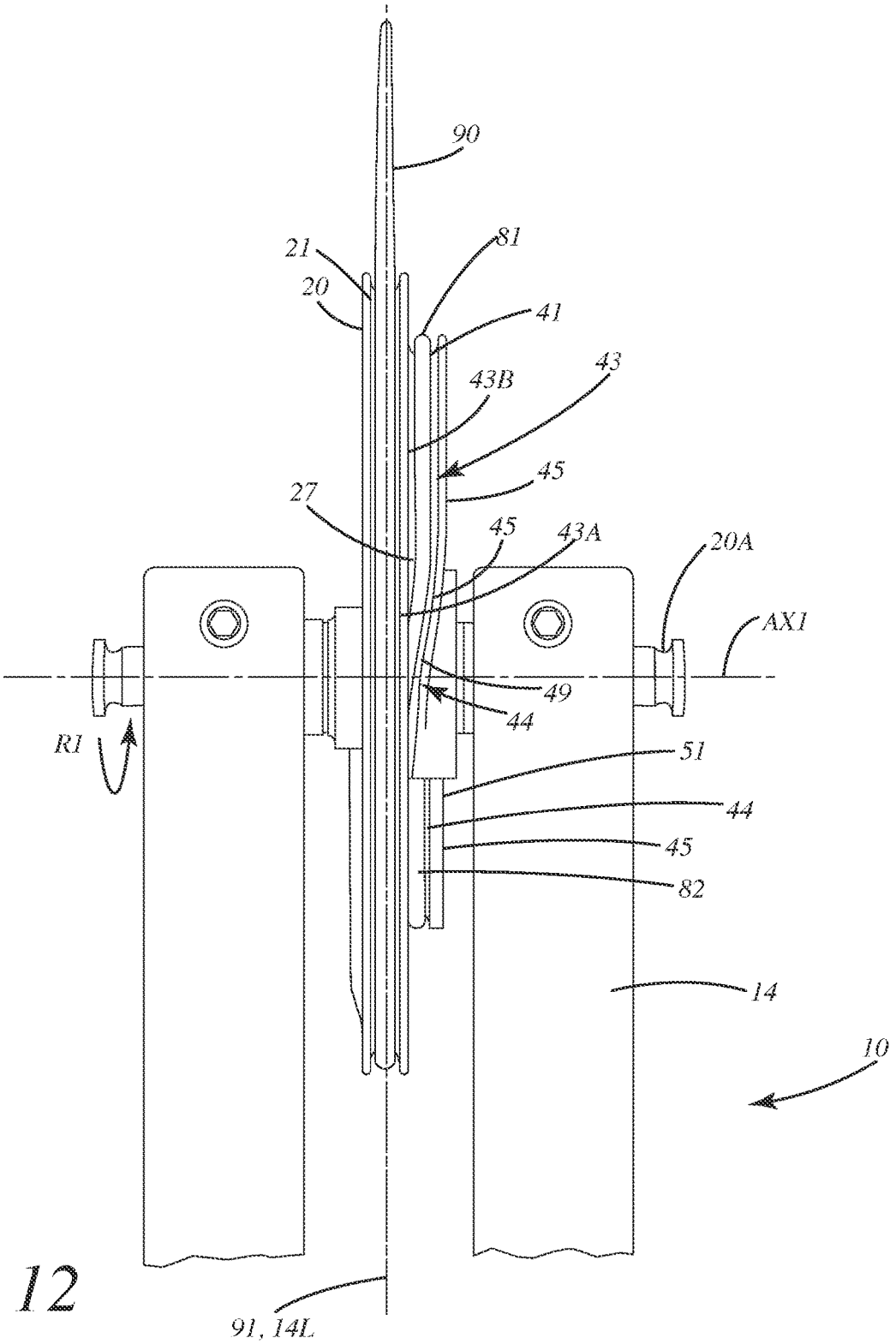
FIG. 12 is a lower perspective view of the lower cam on the archery bow as the bow is further being drawn.

As the bow 10 is further drawn as shown in FIGS. 8 and 12, the cam 20 continues to rotate in direction R1. The bowstring 90 further exits the bowstring track 21. The second power cable 82 also further exits the power cable let out track 51. The first power cable 81 continues to further enter and wind into the first power cable take up track 41 continuing to extend through the first section 43. In addition, the flared sidewall 45 in the second section 44 can begin to engage the power cable 81 to transition or displace the power cable toward the first plane P1 and the centerline 14L of the limb 14. In so doing, the power cable 81 can be angled and/or curved toward the first plane P1 in section 43 of the track 41.

Figure 9:
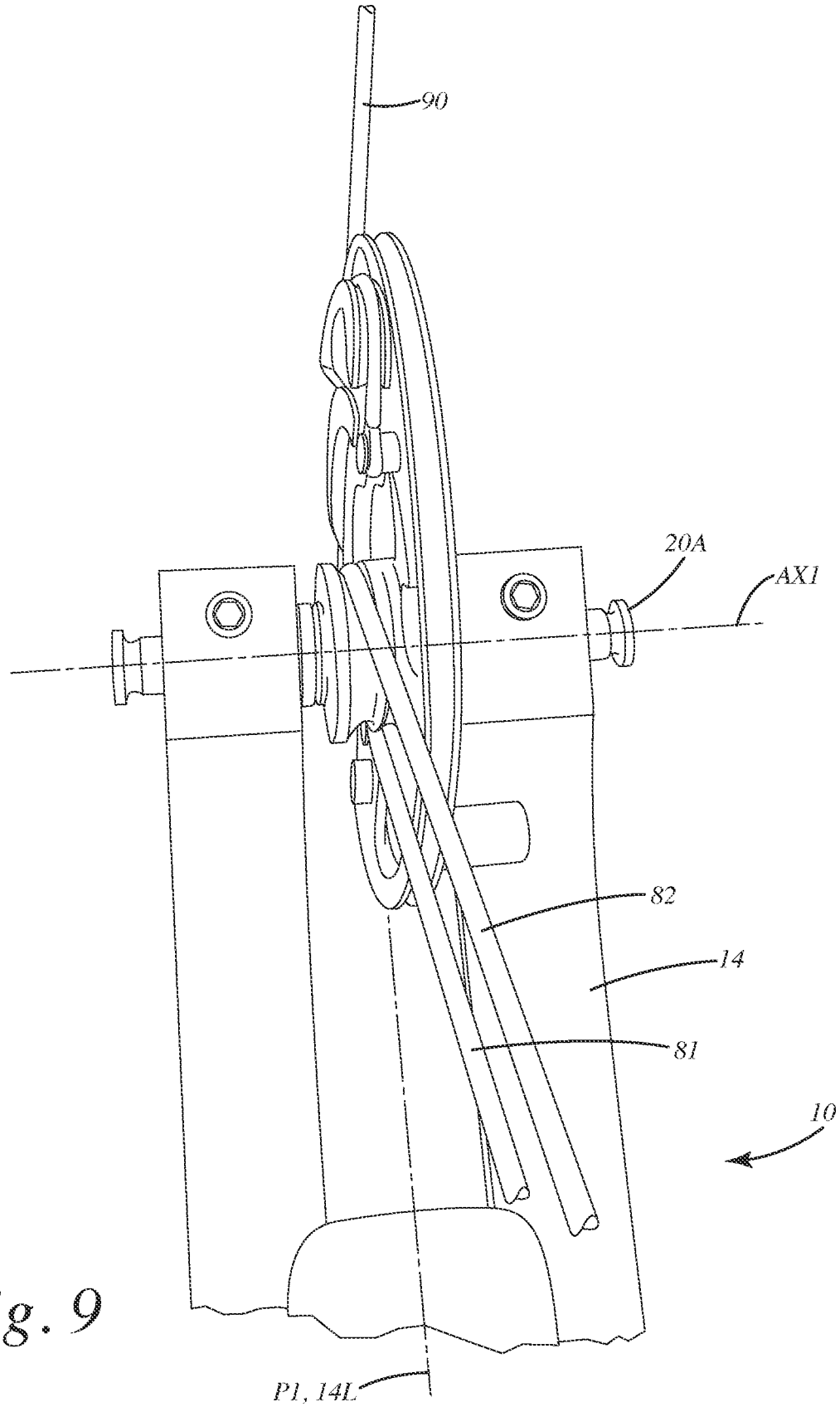
FIG. 9 is an upper perspective view of the lower cam on the archery bow as the bow is at full draw with the power cables displaced toward the axis of rotation of the bowstring track.

The bow 10 can continue to be drawn to the drawn state as shown in FIGS. 9 and 13. The bowstring 90 even further exits the bowstring track 21. The second power cable 82 also further exits the power cable let out track 51. The first power cable 81 can be substantially wound into the first power cable take up track 41, extending and held in position by the first section 43 and the second section 44, as well as the flared guide wall 45 and being disposed in the end part 43E of the let out track 41. As discussed above, the power cable 81 can be displaced such that it intersects and/or crosses through the plane first plane P1 and/or the centerline 14L of the limb 14. As a result of this intersection or crossing, the part 81X of power cable 81 shown in broken lines in FIG. 13 overlaps the bowstring 90 in the bowstring track 21, and that track 21 itself, by an overlap width OL, shown in FIG. 13. This overlap width OL can be optionally at least ⅛, at least ¼, at least ½, at least ¾ or all of the width W81 of the first power cable 81. This overlap also can exist around the first axis for an angle A6, which optionally can be between 10° and 120°, inclusive, between 20° and 100°, inclusive, between 30° and 50°, inclusive, at least 10°, at least 25°, at least 45° or at least 90° depending on the application.

The first power cable 81 also can be partially or entirely disposed below the lateral side surface 27 of the cam 20, which is why a substantial portion of it is shown in broken lines in the view in FIG. 13. Generally, all or a portion of the power cable can lay between the bowstring 20 and the first axis AX1 when taken along a radial line extending outwardly from the axis AX1. As mentioned above, this can redistribute the forces exerted by the first power cable 81 and second power cable 82 closer to the plane P1, the center C1 and the centerline 14L of the limb to reduce the moment, twisting and/or torque on that limb.

After the bow is fully drawn, it can be shot. As a result, and as mentioned above, the moment and torque exerted by the power cables during the initial part of the shot cycle can remain low, so that the cam does not lean much then, and so that nock travel remains level and consistent.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. An archery bow comprising:

a riser;

a first limb and a second limb joined with the riser;

a first cam rotatably mounted to the first limb about a first axis, the first cam comprising:

a first bowstring track having a first plane of rotation perpendicular to the first axis;

a first power cable take up track extending in a direction laterally away at a first angle from the first plane of rotation of the first bowstring track;

a second cam rotatably mounted to the second limb about a second axis, the second cam comprising:

a second bowstring track having a second plane of rotation perpendicular to the second axis;

a second power cable take up track extending in a direction laterally away at a second angle from the second plane of rotation of the second bowstring track;

a bowstring received in first and second bowstring tracks and moveable in a bowstring plane, the bowstring configured to unwind out from the first and second bowstring tracks when the bowstring is drawn;

a first power cable received in the first power cable take up track of the first cam; and a second power cable received in the second power cable take-up track of the second cam, wherein the bowstring is distal and separated from the first power cable and the second power cable, wherein as the archery bow is drawn the first power cable is taken up in the first power cable take up track and displaced along the first axis toward the first plane of rotation of the first bowstring track to concentrate a first force of the first power cable near a first force of the bowstring along the first axis to inhibit twisting of the first limb, wherein as the archery bow is drawn the second power cable is taken up in the second power cable take up track and displaced along the second axis toward the second plane of rotation of the second bowstring track to concentrate a second force of the second power cable near a second force of the bowstring along the second axis to inhibit twisting of the second limb.

2. The archery bow of claim 1, wherein the first power cable take up track transitions toward the first plane of rotation, wherein the second power cable take up track transitions toward the second plane of rotation.

3. The archery bow of claim 1, wherein the first power cable includes an initial power cable contact point contacting the first power cable take up track at a first distance from the first plane of rotation when the archery bow is undrawn, wherein the first power cable includes a subsequent power cable contact point contacting the first power cable take up track at a second distance from the first plane of rotation when the archery bow is drawn, wherein the second distance is less than the first distance so that the subsequent power cable contact point is closer to the first plane of rotation when the bow is drawn.

4. The archery bow of claim 1, wherein the first power cable is displaced along the first axis toward the first plane of rotation of the first bowstring track so that the first power cable intersects the first plane of rotation within a first cam perimeter of the first cam.

5. The archery bow of claim 4, wherein the first power cable intersects the first plane of rotation within a first cam perimeter of the first cam before the archery bow is fully drawn in a fully drawn state, wherein the first power cable moves away from the first plane of rotation so that the first power cable no longer intersects the first plane of rotation when the first cam transitions from the fully drawn state to an undrawn state.

6. The archery bow of claim 1, wherein the first power cable take up track includes a first end of draw part, wherein the first plane of rotation extends through the first bowstring track and through the first end of draw part of the first power cable take up track, wherein the first end of draw part is located between the first axis and the first bowstring track.

7. The archery bow of claim 1, comprising:

a first power cable let out track on the first cam, wherein the second power cable extends away from the second cam and is received in the first power cable let out track on the first cam;

wherein as the archery bow is drawn the second power cable is let out by the first power cable let out track and displaced along the first axis toward the first plane of rotation of the first bowstring track.

8. The archery bow of claim 1, wherein the first power cable take up track curves around the first axis toward the first plane so that the first power cable is guided toward the first plane as the first power cable is taken up in the first power cable take up track, curving toward the first plane as the bow is drawn.

9. The archery bow of claim 1 comprising:

a bowstring anchor projecting from the first cam;

a bowstring end of the bowstring being joined with the bowstring anchor;

a power cable anchor projecting from the first cam; and a first power cable end of the first power cable being joined with the power cable anchor distal from the bowstring anchor.

10. The archery bow of claim 1, comprising:

a first power cable let out track on the first cam, wherein the first power cable take up track transitions a first force from the first power cable therein toward the bowstring plane as the archery bow is drawn, wherein the first power cable let out track transitions a second force from the second power cable therein toward the bowstring plane as the archery bow is drawn.

11. The archery bow of claim 1, comprising:

a first centerline of the first limb, wherein the first centerline lays in the bowstring plane, wherein the first plane of rotation is parallel to the bowstring plane.

12. The archery bow of claim 1, comprising:

an axle having a center, wherein the first plane of rotation passes through the center.

13. The archery bow of claim 1, a bowstring anchor projecting from the first cam;

a bowstring end of the bowstring being joined with the bowstring anchor;

a power cable anchor projecting from the first cam;

a first power cable end of the first power cable being joined with the power cable anchor distal from the bowstring anchor;

a first power cable let out track on the first cam; and a second power cable in the first power cable let out track, wherein the first power cable take up track transitions a first force from the first power cable therein toward the bowstring plane as the archery bow is drawn, wherein the first power cable let out track transitions a second force from the second power cable therein toward the bowstring plane as the archery bow is drawn.

14. An archery bow comprising:

a first limb and a second limb;

a first cam rotatably mounted to the first limb about a first axis, the first cam comprising:

a first bowstring track having a first plane of rotation perpendicular to the first axis;

a first power cable take up track extending in a direction angled laterally away from the first plane of rotation of the first bowstring track;

a bowstring received in a first bowstring track and moveable in a bowstring plane, the bowstring configured to unwind out from the first bowstring track when the bowstring is drawn;

a first power cable received in the first power cable take up track of the first cam;

wherein as the archery bow is drawn the first power cable is taken up in the first power cable take up track and displaced along the first axis toward the first plane of rotation of the first bowstring track to move a first force of the first power cable near a first force of the bowstring along the first axis to inhibit twisting of the first limb, wherein the bowstring is distal and separated from the first power cable.

15. The archery bow of claim 14, comprising:

a first power cable let out track on the first cam, wherein a second power cable is received in the first power cable let out track on the first cam;

wherein as the archery bow is drawn the second power cable is let out by the first power cable let out track and displaced along the first axis toward the first plane of rotation of the first bowstring track.

16. The archery bow of claim 14, comprising:

a first power cable let out track on the first cam, wherein the first power cable take up track is located between the first power cable let out track and the first bowstring track along the first axis, wherein the first power cable take up track transitions a first force from the first power cable toward the bowstring plane, wherein the first power cable let out track transitions a second force from the second power cable toward the bowstring plane.

17. The archery bow of claim 14, wherein the first power cable intersects the first plane of rotation within a first cam perimeter of the first cam before the archery bow is fully drawn.

18. The archery bow of claim 14 comprising:

a bowstring anchor projecting from the first cam;

a bowstring end of the bowstring being joined with the bowstring anchor;

a power cable anchor projecting from the first cam; and a first power cable end of the first power cable being joined with the power cable anchor distal from the bowstring anchor.

19. The archery bow of claim 14, comprising:

a first power cable let out track on the first cam; and a second power cable in the first power cable let out track, wherein the first power cable take up track transitions a first force from the first power cable therein toward the bowstring plane as the archery bow is drawn, wherein the first power cable let out track transitions a second force from the second power cable therein toward the bowstring plane as the archery bow is drawn.

20. The archery bow of claim 14, comprising:

a first centerline of the first limb;

an axle having a center;

wherein the first centerline lays in the bowstring plane, wherein the first plane of rotation is parallel to the bowstring plane, wherein the first plane of rotation passes through the center.

* * * * *